US006075923A

United States Patent [19]

Wu

[11] Patent Number: 6,075,923

[45] Date of Patent: Jun. 13, 2000

[54] SELF-COMPENSATORY WATER HEATER SENSITIVELY RESPONSIVE TO TEMPERATURE VARIATIONS

[76] Inventor: Ya-Ching Wu, No. 116, San-Ming Road, Yang-Mei, Taoyuan Hsien, Taiwan

[21] Appl. No.: 09/231,264

[22] Filed: Jan. 15, 1999

[51] Int. Cl.[7] ..... F24H 1/20

[52] U.S. Cl. ..... 392/451; 392/498; 392/500

[58] Field of Search ..... 392/441, 449, 392/451, 454, 455, 497, 498; 219/385, 438, 441; 126/373

[56] References Cited

U.S. PATENT DOCUMENTS

| | | | |
|---|---|---|---|
| 4,455,477 | 6/1984 | Wu | 392/451 |
| 4,680,446 | 6/1984 | Post | 392/451 |
| 5,499,621 | 3/1996 | Trihey | 126/361 |

*Primary Examiner*—Philip H. Leung
*Assistant Examiner*—Thor Campbell

[57] ABSTRACT

A water heater includes: a reservoir having a feed pipe protruding inwardly into the reservoir for directing cold water into the reservoir; a main heater having a main thermostat sensor juxtapositionally secured in an immersion pipe section of the feed pipe inserted in the reservoir and a main electric heater electrically connected with the main thermostat sensor through a controller connected to a power source, whereby upon sensing of a preset high temperature by the main thermostat sensor, the main electric heater will be actuated to heat the water fed into the reservoir to the preset high temperature; and at least an auxiliary heater having an auxiliary thermostat sensor mounted in an outer pipe section of the feed pipe outside the reservoir and an auxiliary electric heater electrically connected with the auxiliary thermostat sensor, whereby upon sensing of a preset low temperature by the auxiliary sensor outside the reservoir, the auxiliary electric heater will also be actuated to heat the water in the reservoir in cooperation with the main heater for quickly heating the water in the reservoir and for quickly supplying warm water as discharged from the reservoir.

10 Claims, 3 Drawing Sheets

SELF-COMPENSATORY WATER HEATER SENSITIVELY RESPONSIVE TO TEMPERATURE VARIATIONS

BACKGROUND OF THE INVENTION

A conventional electric water heater as shown in FIG. 1 includes: a storage tank S having an electric heating coil H and a thermostat T mounted in the tank S, whereby the cold water is fed into the tank through a feed pipe F and the heated or warm water is discharged through the discharge pipe D mounted on a top portion of the tank when heated by the heating coil H and controlled at a constant temperature by the thermostat T.

However, when an appreciable volume of hot water (V) is consumed from the tank S, the cold water will be instantly supplied into the tank and will not be immediately heated to the desired warm temperature, causing a delayed heating of the water and also causing unpleasant feeling for the user such as someone waiting for washing his hair in a barber shop especially in a cold weather or winter season.

The present inventor has found the drawbacks of the conventional water heater and invented the present water heater sensitively responsive to temperature variations.

SUMMARY OF THE INVENTION

The object of the present invention is to provide a water heater including: a reservoir having a feed pipe protruding inwardly into the reservoir for directing cold water into the reservoir; a main heater having a main thermostat sensor juxtapositionally secured in an immersion pipe section of the feed pipe inserted in the reservoir and a main electric heater electrically connected with the main thermostat sensor through a controller connected to a power source, whereby upon sensing of a preset high temperature by the main thermostat sensor, the main electric heater will be actuated to heat the water fed into the reservoir to the preset high temperature; and at least an auxiliary heater having an auxiliary thermostat sensor mounted in an outer pipe section of the feed pipe outside the reservoir and an auxiliary electric heater electrically connected with the auxiliary thermostat sensor, whereby upon sensing of a preset low temperature by the auxiliary sensor outside the reservoir, the auxiliary electric heater will also be actuated to heat the water in the reservoir in cooperation with the main heater for quickly heating the water in the reservoir and for quickly supplying warm water as discharged from the reservoir.

DETAILED DESCRIPTION

Figure 1:
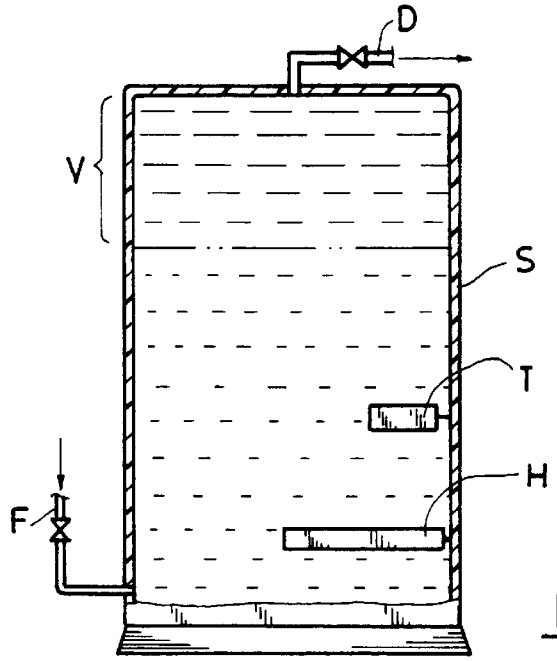
FIG. 1 PRIOR ART
FIG. 1 is an illustration showing a conventional electric water heater.
Figure 2:
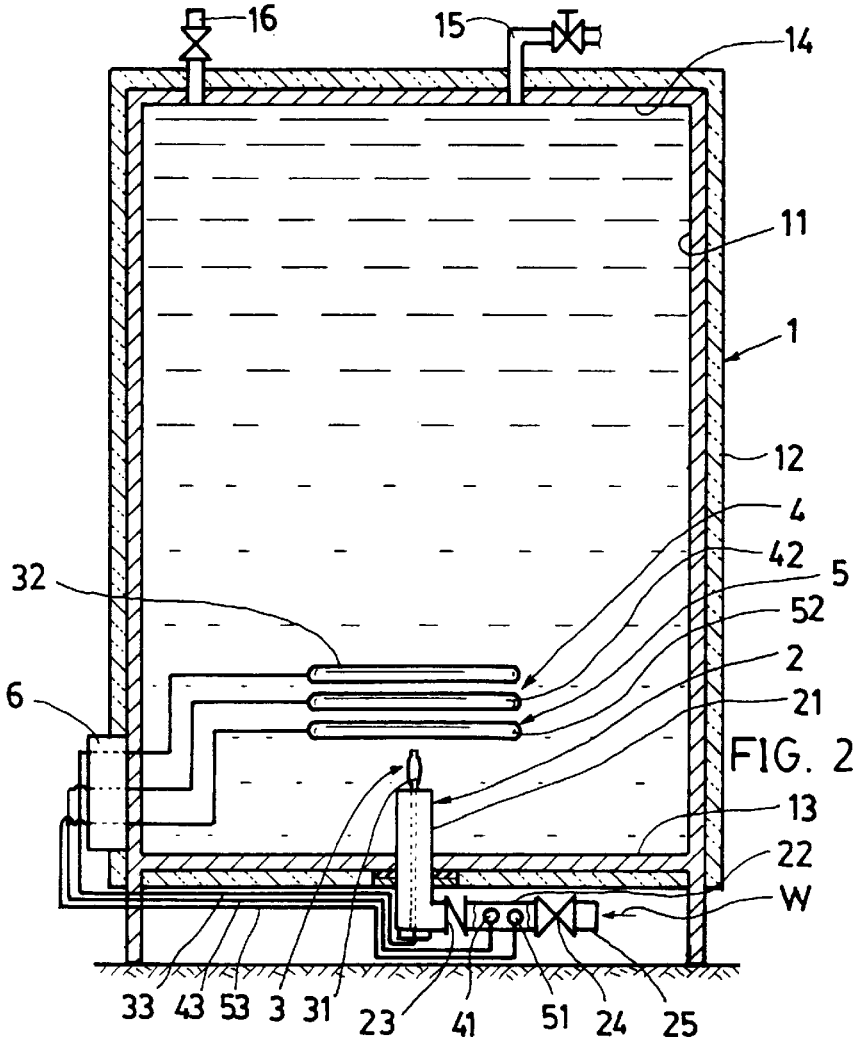
FIG. 2 is a sectional drawing of the present invention.
Figure 3:
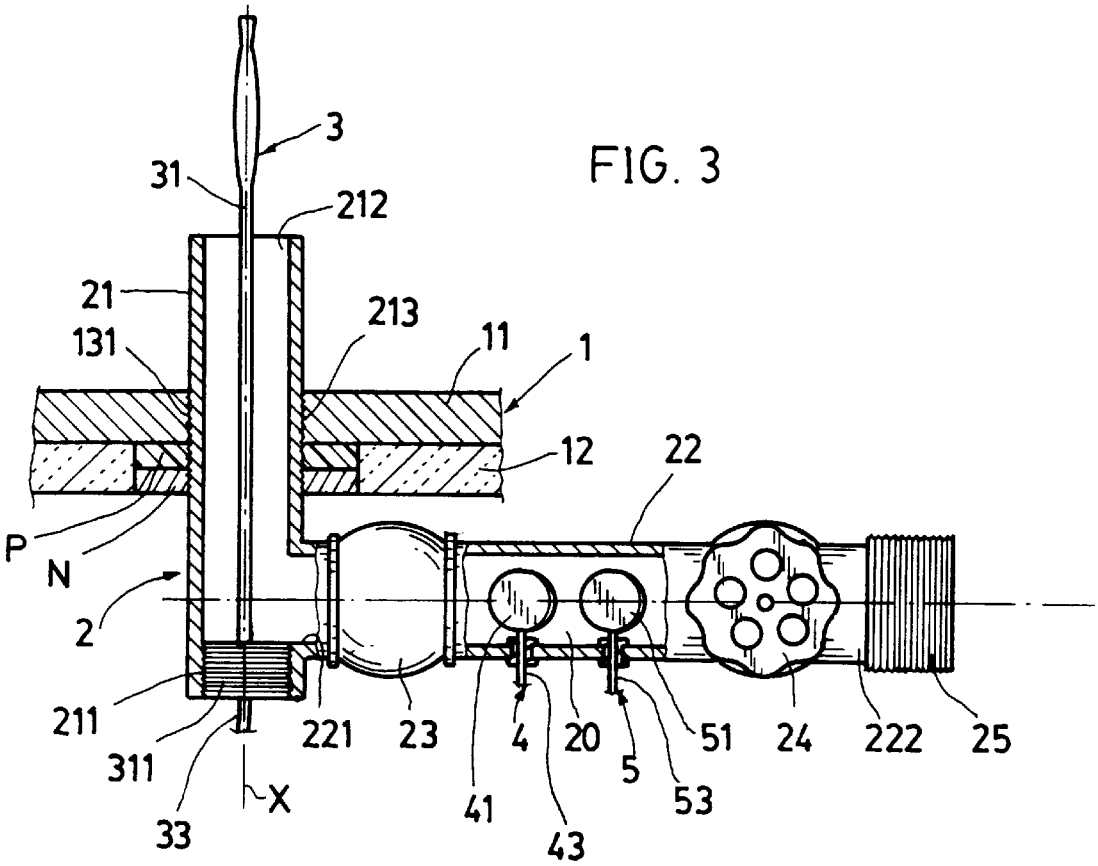
FIG. 3 is a partial enlarged illustration showing the feed pipe and the related sensors in accordance with the present invention.
Figure 4:
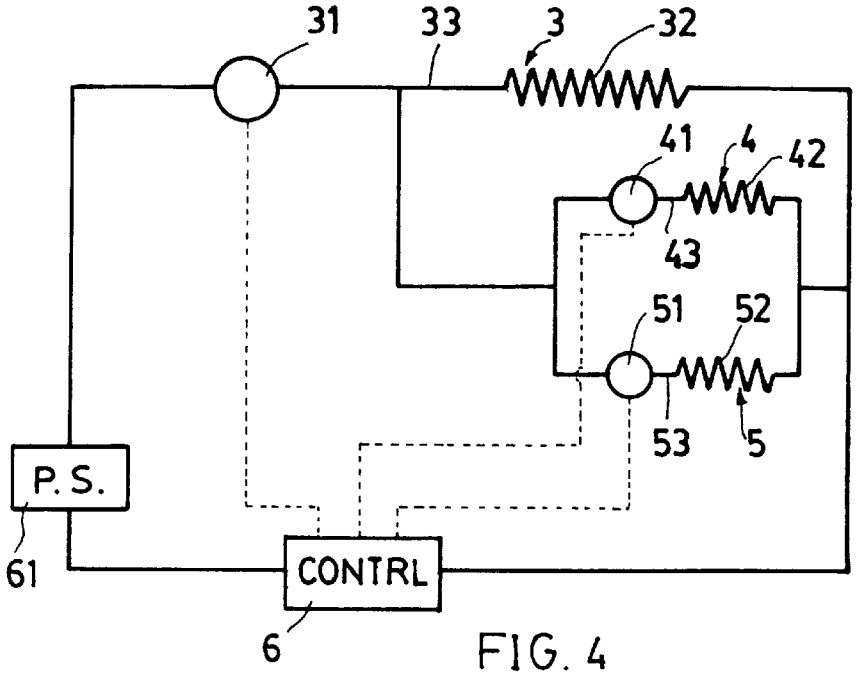
FIG. 4 is an electric circuit block diagram of the present invention.

As shown in FIGS. 2~4, the present invention comprises: a reservoir 1, a feed pipe 2 secured on a bottom portion or a lower portion of the reservoir 1, a main heating means 3 respectively mounted in the feed pipe 2 and in the reservoir

1, at least an auxiliary heating means respectively mounted in the feed pipe 2 and in the reservoir including a first auxiliary heating means 4 and a second auxiliary heating means 5, and a controller (CONTRL) 6 electrically connected to a power source (PS) 61 and electrically connected with the main heating means 3 and the auxiliary heating means 4, 5.

The reservoir 1 includes: a tank 11 generally cylindrical shaped (but not limited for the shapes), a thermally insulative layer 12 coated on an outside surface of a tank wall of the tank 11, a bottom portion 13 and a top portion 14 respectively formed on a bottom and a top portion of the tank 11, a discharge pipe 15 mounted on a top or an upper portion of the tank 11, and a safety valve 16 provided on a top portion of the tank 1 for an emergency venting purpose if the steam exerting in the reservoir exceeds a predetermined safety pressure.

The tank 11 is generally positioned below a larger main water tank such as designed and provided for a building or an apartment use for gravitationally filling cold water into the tank 11 automatically. Naturally, a boosting pump (not shown) may also be provided to feed water into the tank 11 from a water supply source.

The heating means 3 and auxiliary heating means 4, 5 may be electric heating means as illustrated and described in this invention. However, other energy sources besides the electricity may also be provided to heat the heating means 3, 4, 5 of this invention, not limited in the present invention.

The feed pipe 2 may be formed as a "cassette type" for easily mounting on the reservoir 1 or for an easy dismantling from the reservoir 1 for maintenance.

Although the three heating means 3, 4, 5 are parallelly or juxtapositionally mounted in the tank 11 as shown in FIG. 2, other arrangements or constructions for accommodating the several heating means 3, 4, 5 within the tank 11 may be otherwise modified by those skilled in the art, not limited in the present invention.

The feed pipe 2 includes: an immersion pipe section 21 protruding into a bottom or lower portion of the reservoir 1, an outer pipe section 22 perpendicular to the immersion pipe 21, a check valve 23 and a main valve 24 respectively formed on the outer pipe section 22 of the feed pipe 2 having a pipe interior 20 spaced and defined between the check valve 23 and the main valve 24, and an adapter 25 formed at an outer end portion of the outer pipe section 22 for connecting a supply pipe or hose (not shown) connectable to a water source or a large building water reservoir (not shown) for directing cold water into the reservoir 1 through the one-way input control by the check valve 23 and the on-off control by the main valve 24.

The outer pipe section 22 has its inner end portion 221 connected and communicated with the immersion pipe section 21 and has an outer end portion 222 of the outer pipe section 22 formed as the adapter 25 for connecting the water supply pipe.

The main heating means 3 includes: a main thermostat sensor 31 having a "high" constant temperature preset therein and juxtapositionally secured in the immersion pipe section 21 of the feed pipe 2 for sensing an inside temperature in the feed pipe 2 in a lower portion of the reservoir 1, and a main electric heating element 32 mounted in the reservoir and electrically connected (by wires 33) to the main thermostat sensor 31 through the controller (CONTRL) 6 which is mounted on the reservoir 1 and electrically connected to a power source (PS) 61, whereby upon sensing of the inside temperature to be below the preset high temperature by the main thermostat sensor 31, the main heating element 32 will be actuated for heating water in the reservoir until reaching the preset high temperature.

The main thermostat sensor 31 may be formed to have a tubular probe casing coaxially mounted in the immersion pipe section 21 of the feed pipe 2 to be aligned with a longitudinal axis X defined at a longitudinal center of the immersion pipe section 21.

The main thermostat sensor 31 includes a male-threaded plug portion 311 formed on a bottom of the main thermostat sensor 31 to be engaged with a female-threaded hole 211 formed in an outer end portion of the immersion pipe section 21 adjacent to an inner end portion 221 of the outer pipe section 22 perpendicular to the immersion pipe section 21, and the immersion pipe section 21 having an inlet port 212 formed on an inner end portion of the immersion pipe 21 and annularly defined between the main thermostat sensor 31 and an inside pipe wall of the immersion pipe section 21 of the feed pipe 2.

The main electric heating element 32 may be an electric heating coil, a PTC (positive-temperature-coefficient) semiconductor or other heating elements, not limited in the present invention.

The thermostat sensor 31 may be a liquid sensor, an electromagnetic sensor, a bimetal sensor, or any other suitable sensors, not limited in the present invention.

The controller 6 includes a main switch for on-off control of the power supply from the power source 61, and at least an adjusting means (not shown) for adjusting the predetermined or preset heating or warming temperatures of the heating means 3.

The immersion pipe section 21 of the feed pipe 2 is formed with a male-threaded portion 213 to be engaged with a female-threaded hole 131 formed in the bottom portion 13 of the reservoir 1 for rotatably mounting the immersion pipe section 21 of the feed pipe 2 on the reservoir 1 by rotatably driving the outer pipe section 22 which serves as a "handle" for fixing the feed pipe 2 onto the reservoir 1. A packing P and washer or nut N are provided for firmly fastening the pipe 2 on the reservoir 1 (FIG. 3).

The main heating means 3 is provided for heating water to a "high" temperature, e.g., 60~62° C.; while the first auxiliary heating means 4 is provided for heating water to a "medium" temperature, e.g., 20~22° C.; and the second auxiliary heating means 5 for heating water to a "low" temperature, e.g., 15~17° C.; not limited in the present invention.

The first and second auxiliary heating means 4, 5 are especially provided for uses in cold weather, winter season or cold areas. So, they may also be omitted in hot weather or tropical areas.

The first auxiliary heating means 4 includes: a first auxiliary thermostat sensor 41 having a "medium" constant temperature preset therein and juxtapositionally secured in the outer pipe section 22 of the feed pipe 2 for sensing a temperature in the pipe outside the reservoir, and a first auxiliary electric heating element 42 mounted in the reservoir and electrically connected (by wires 43) to the first auxiliary thermostat sensor 41, whereby upon sensing of the temperature to be below the preset medium temperature by the first auxiliary thermostat sensor 41, the first auxiliary heating element 42 will be actuated for heating water in the reservoir until reaching the preset medium temperature.

The first auxiliary thermostat sensor 41 may be formed with a bimetal sensor, but not limited in the present invention and may also be electrically connected with the first auxiliary electric heating element 42 through the controller 6 which is provided for on-off control of the power source and provided for adjusting the preset temperature for heating the water by the first auxiliary heating element 42, if necessarily.

The second auxiliary heating means 5 includes: a second auxiliary thermostat sensor 51 having a "low" constant temperature preset therein and juxtapositonally secured in the outer pipe section 22 of the feed pipe 2 for sensing a temperature in the pipe outside the reservoir, and a second auxiliary electric heating element 52 mounted in the reservoir electrically connected (by wires 53) to the second auxiliary thermostat sensor 51, whereby upon sensing of the temperature to be below the preset low temperature by the second auxiliary thermostat sensor, the second auxiliary heating element 52 will be actuated for heating water in the reservoir until reaching the preset low temperature.

The second auxiliary sensor 51 may be formed with a bimetal sensor, and may be electrically connected with the second auxiliary heating element 52 through the controller 6.

The first and second auxiliary thermostat sensors 41, 51 are each juxtapositionally secured in the pipe interior 20 preferably between the check valve 23 and the main valve 24 on the feed pipe 2, and positioned outside the reservoir 1 to be sensitively responsive to the environmental temperature variations to instantly sense the outside temperature for an instant sensing and actuation of the auxiliary heating means 4, 5 once the environmental temperature is below the temperature data as preset by the auxiliary thermostat sensor 41, 51.

So, when using the present invention such as in a winter season (or cold area) somewhere the environmental temperature is, for instance, 13° C. which is below the temperature as preset by the second auxiliary thermostat sensor 51 of the second auxiliary heating means 5, the cold water W as fed into the reservoir 1 through the pipe 2 will be simultaneously sensed by the first and second auxiliary sensors 41, 51 in the outer pipe section 22 and the main sensor 31 in the immersion pipe section 21 of the pipe 2 to thereby actuate the first and second auxiliary heating means 4, 5 and the main heating means 3 for heating the cold water simultaneously in order for quickly heating or warming the water W in the reservoir 1 for an instant supply of hot water for the user without delay. As shown in FIG. 4, the first and second heating means 4, 5 are connected in parallel with two opposite ends of the main heating element 31 and connected in series with the main sensor 31 and the power source 61.

In summer season when there is, for example, an environmental temperature of 30° C., both auxiliary sensors 41, 51 are not actuated and only the main sensor 31 will sense such temperature to actuate the main heating element 32 to the desired preset temperature (e.g., 60~62° C.), thereby limiting and selecting the actuation of the plural heating elements 32, 42, 52, depending upon the actual environmental or piping temperature. Such an arrangement may help "soothe" the electricity burden of the municipal power supply in a summer season generally encountering a heavy load of electric energy consumption.

The present invention may thus sensitively sense the environmental temperature for quickly heating up the water in the reservoir for a quicker supply of hot or warm water.

Figure 5:
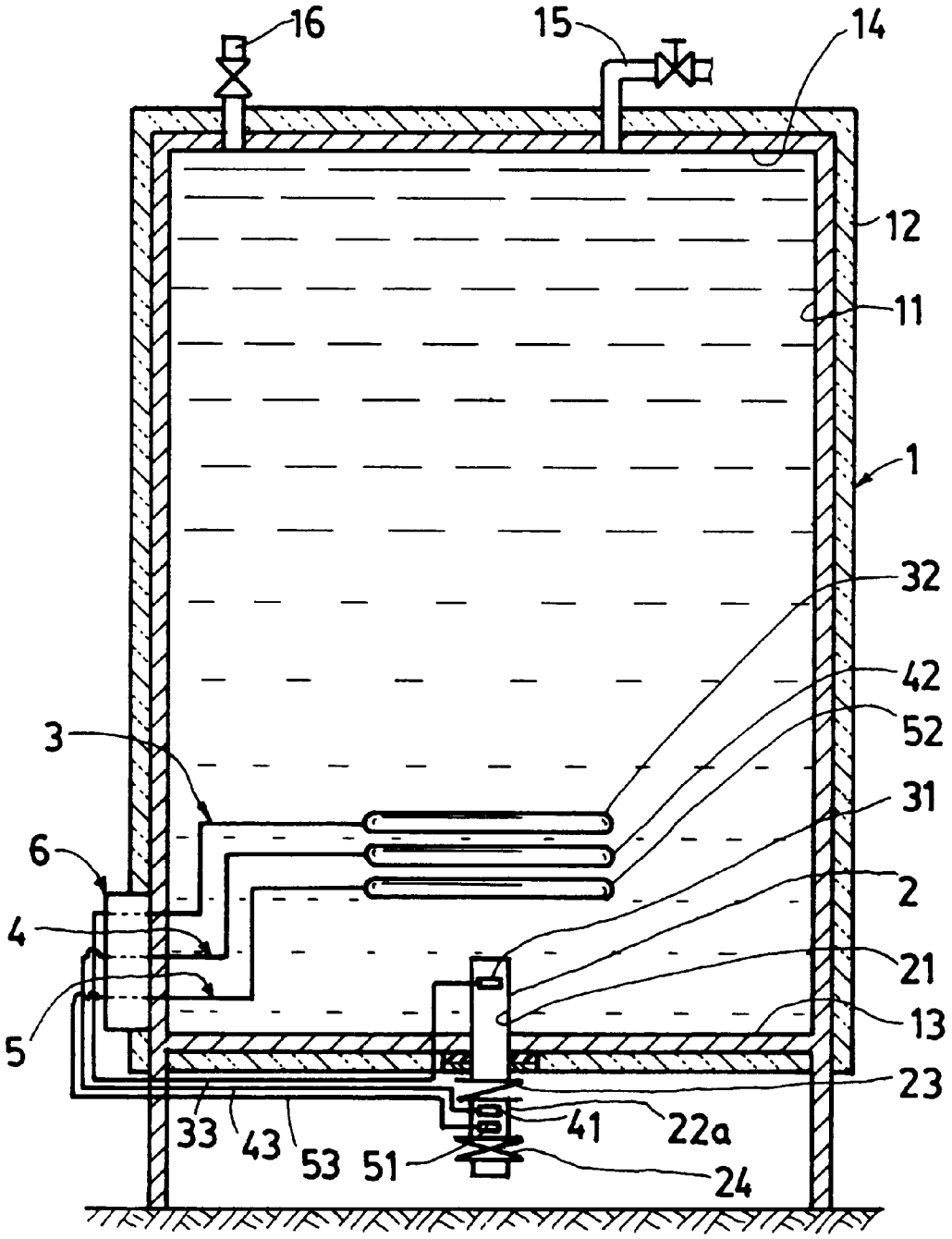
FIG. 5 shows another preferred embodiment of the present invention.

As shown in FIG. 5, the feed pipe 2 is modified to include: an immersion pipe section 21 protruding inwardly in a bottom or lower portion of the reservoir 1, an outer pipe section 22*a* linearly connected to the immersion pipe section 21 and protruding outwardly (or downwardly) from the immersion pipe section 21, a check valve 23 and a main valve 24 juxtapositionally formed on the outer pipe section 22*a*.

The main thermostat sensor 31 may be a bimetal sensor provided in the immersion pipe section 21; while the first and second auxiliary thermostat sensors 41, 51 are mounted in the outer pipe section 22 of the pipe 2.

The present invention is safe in view of the circuit as shown in FIG. 4, the two heating elements 42, 52 may be actuated only when the main sensor 31 is actuated. If the main sensor 31 is not actuated (such as a high temperature already existing inside the reservoir), the two sensors 41, 51 of the auxiliary heating elements 42, 52 will not be actuated, thereby preventing overheating in the reservoir and ensuring its safety.

The present invention may be modified without departing from the spirit and scope of this invention. For simplified purpose, the controller 6 may also be modified to be an on-off control of power supply.

I claim:

1. A water heater comprising:

a reservoir (1) having a feed pipe (2) mounted on and inserted in a bottom or lower portion of the reservoir (1) for directing water into said reservoir (1), and a discharge pipe (15) mounted on a top portion for discharging water outwardly as heated in said reservoir (1);

a main heating means (3) including a main thermostat sensor (31) having a high constant temperature preset therein and juxtapositionally secured in said feed pipe (2) protruding inwardly in said reservoir for sensing an inside temperature in said feed pipe (2) and in said reservoir (1), and a main electric heating element (32) electrically connected to the main thermostat sensor (31) and electrically connected to a power source (61) through a controller (6) mounted on the reservoir (1) for switching on or off a power supply to the main electric heating means (32), whereby upon sensing of the inside temperature to be below the preset high constant temperature by the main thermostat sensor (31), the main heating element (32) will be actuated for heating water in said reservoir until reaching the preset high constant temperature; and at least an auxiliary heating means (4, 5) having an auxiliary thermostat sensor (41, 51) preset therein a medium or low constant temperature and secured in said feed pipe (2) outside the reservoir (1) for sensing a temperature in said feed pipe (2) outside the reservoir, and an auxiliary electric heating element (42, 52) mounted in the reservoir and electrically connected to said auxiliary thermostat sensor (41, 51), whereby upon sensing of the temperature to be below the preset medium or low constant temperature by the auxiliary thermostat sensor, said auxiliary heating element will be actuated for heating water in said reservoir until reaching the preset medium or low constant temperature.

2. A water heater according to claim 1, wherein said feed pipe (2) includes: an immersion pipe section (21) protruding into a bottom or lower portion of the reservoir (1) for mounting the main thermostat sensor (31) of said main heating means (3) in said immersion pipe section (21), an outer pipe section (22) perpendicular to the immersion pipe (21) for mounting said auxiliary thermostat sensor therein, a check valve (23) and a main valve (24) respectively formed on the outer pipe section (22) of the feed pipe (2) having a pipe interior (20) spaced and defined between the check valve (23) and the main valve (24) for securing said auxiliary thermostat sensor (41, 51) in said outer pipe section (22), and an adapter (25) formed at an outer end portion of the outer pipe section (22) for connecting a supply pipe connectable to a water source for directing water into the reservoir (1) through the check valve (23) and the main valve (24).

3. A water heater according to claim 2, wherein said main thermostat sensor (31) is formed with a tubular probe casing coaxially mounted in the immersion pipe section (21) of the feed pipe (2) to be aligned with a longitudinal axis (X) defined at a longitudinal center of the immersion pipe section (21).

4. A water heater according to claim 3, wherein said main thermostat sensor (31) includes a male-threaded plug portion (311) formed on a bottom of the main thermostat sensor (31) to be engaged with a female-threaded hole (211) formed in an outer end portion of the immersion pipe section (21) adjacent to an inner end portion (221) of an outer pipe section (22) perpendicular to the immersion pipe section (21), and the immersion pipe section (21) having an inlet port (212) formed on an inner end portion of the immersion pipe (21) and annularly defined between the main thermostat sensor (31) and an inside pipe wall of the immersion pipe section (21) of the feed pipe (2).

5. A water heater according to claim 2, wherein said immersion pipe section (21) of the feed pipe (2) is formed with a male-threaded portion (213) to be engaged with a female-threaded hole (131) formed in a bottom portion (13) of the reservoir (1) for rotatably mounting the immersion pipe section (21) of the feed pipe (2) on the reservoir (1) by rotatably driving the outer pipe section (22) which serves as a handle for fixing the feed pipe (2) onto the reservoir (1).

6. A water heater according to claim 1, wherein said auxiliary heating means (4, 5) includes: a first auxiliary heating means (4) including: a first auxiliary thermostat sensor (41) having a medium constant temperature preset therein and juxtapositionally secured in the outer pipe section (22) of the feed pipe (2) for sensing a temperature in the pipe outside the reservoir, and a first auxiliary electric heating element (42) mounted in the reservoir and electrically connected to the first auxiliary thermostat sensor (41), whereby upon sensing of the temperature to be below the preset medium temperature by the first auxiliary thermostat sensor (41), the first auxiliary heating element (42) will be actuated for heating water in the reservoir until reaching the preset medium temperature.

7. A water heater according to claim 1, wherein said auxiliary heating means (4, 5) further includes: a second auxiliary heating means (5) including: a second auxiliary thermostat sensor (51) having a low constant temperature preset therein and juxtapositonally secured in the outer pipe section (22) of the feed pipe (2) for sensing a temperature in the pipe outside the reservoir, and a second auxiliary electric heating element (52) mounted in the reservoir and electrically connected to the second auxiliary thermostat sensor (51), whereby upon sensing of the temperature to be below the preset low temperature by the second auxiliary thermostat sensor, the second auxiliary heating element (52) will be actuated for heating water in the reservoir until reaching the preset low temperature.

8. A water heater according to claim 2, wherein said auxiliary thermostat sensors (41, 51) is juxtapositionally secured in the pipe interior (20) between the check valve (23) and the main valve (24) on the feed pipe (2), and positioned outside the reservoir (1) to be responsive to the environmental temperature variations to instantly sense the temperature outside the reservoir for an instant sensing and actuation of the auxiliary heating means once the environmental temperature is below a temperature as preset by the auxiliary thermostat sensor (41, 51).

9. A water heater according to claim 1, wherein said feed pipe (2) includes: an immersion pipe section (21) protruding inwardly in a bottom or lower portion of the reservoir (1), an outer pipe section (22*a*) linearly connected to the immersion pipe section (21) and protruding outwardly from the immersion pipe section (21), a check valve (23) and a main valve (24) juxtapositionally formed on the outer pipe section (22*a*).

10. A water heater according to claim 1, wherein said auxiliary heating means (4, 5) is connected in paralled with two opposite ends of the main heating element (32) of said main heating means (3), and said auxiliary heating means (4, 5) is connected in series with said main thermostat sensor (31) of said main heating means (3) and said power source (61), whereby upon no actuation of said main thermostat sensor (31), said auxiliary heating means (4, 5) is not actuated; and upon actuation of said main thermostat sensor (31) to close said main heating element (32) with the power source (61), said auxiliary heating means (4, 5) is capable of being actuated.

* * * * *